US005457859A

United States Patent [19]

Kacprowicz et al.

[11] Patent Number: 5,457,859

[45] Date of Patent: Oct. 17, 1995

[54] MODULAR CLIP AND ASSEMBLY USING SAME

[75] Inventors: Deborah J. Kacprowicz, Valley Stream, N.Y.; Rich Franczak, Laurence Harbor, N.J.

[73] Assignee: Display Technologies, Inc., Whitestone, N.Y.

[21] Appl. No.: 290,584

[22] Filed: Aug. 15, 1994

[51] Int. Cl.[6] ..... A44B 19/18; A47F 7/00

[52] U.S. Cl. ..... 24/573.1; 24/697.1; 211/59.2; 403/292; 403/293

[58] Field of Search ..... 24/573.1, 701, 24/666, 667, 697.1, 573.5, 573.6, 630–632; 211/59.2, 175; 403/292–294, 326

[56] References Cited

U.S. PATENT DOCUMENTS

| | | | |
|---|---|---|---|
| 2,065,899 | 12/1936 | Lamel . | |
| 2,484,769 | 10/1949 | Wolters . | |
| 3,046,852 | 7/1962 | Graham . | |
| 3,751,770 | 8/1973 | Italiano | 24/701 X |
| 3,990,131 | 11/1976 | Okamura | 24/573.1 |
| 4,479,575 | 10/1984 | Gründken et al. | 403/294 X |
| 4,913,580 | 4/1990 | Whitehead | 403/326 |
| 5,024,336 | 6/1991 | Spamer | 211/59.2 |
| 5,025,937 | 6/1991 | King | 211/192 |
| 5,050,748 | 9/1991 | Taub | 211/59.2 |
| 5,301,397 | 4/1994 | Baum | 24/701 |

*Primary Examiner*—Kenneth J. Dorner
*Assistant Examiner*—Robert J. Sandy
*Attorney, Agent, or Firm*—Amster, Rothstein & Ebenstein

[57] ABSTRACT

A modular clip is adapted to releasably secure together a pair of articles for movement as unit. Each article has an article body, a lug protruding from the article body, and a transversely-extending flange at the free end of the lug. The clip includes a generally planar clip body defining a central T-shaped opening therein including a wide aperture zone with widely spaced sides and a narrow aperture zone with relatively narrowly spaced sides, the wide and narrow apertures zones being in operative communication with one another. Each of the narrowly spaced sides defines a plane inclined relative to the clip body and extending from the adjacent wide aperture zone to adjacent a far end of the narrow aperture zone, whereby the inclined planes of the clip may be pressure fit intermediate the article body and the article flanges to preclude accidental displacement of the clip from the articles when the pressure-fit clip holds in juxtaposition the lugs of a pair of adjacent articles. The assembly includes, in combination, at least one modular clip and a pair or articles.

7 Claims, 9 Drawing Sheets

FIG. 4
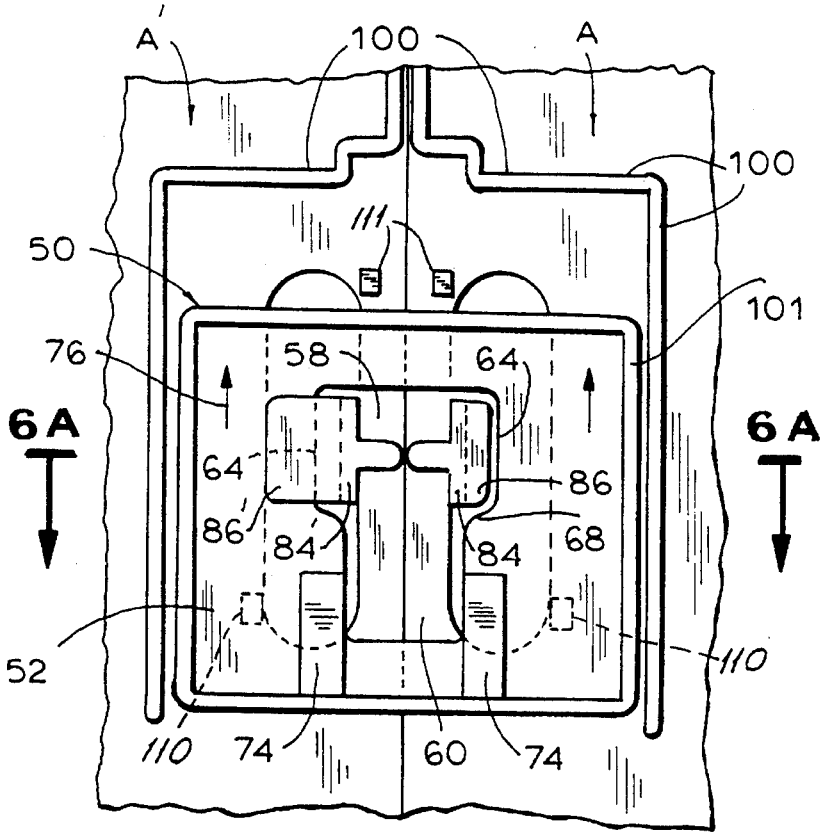
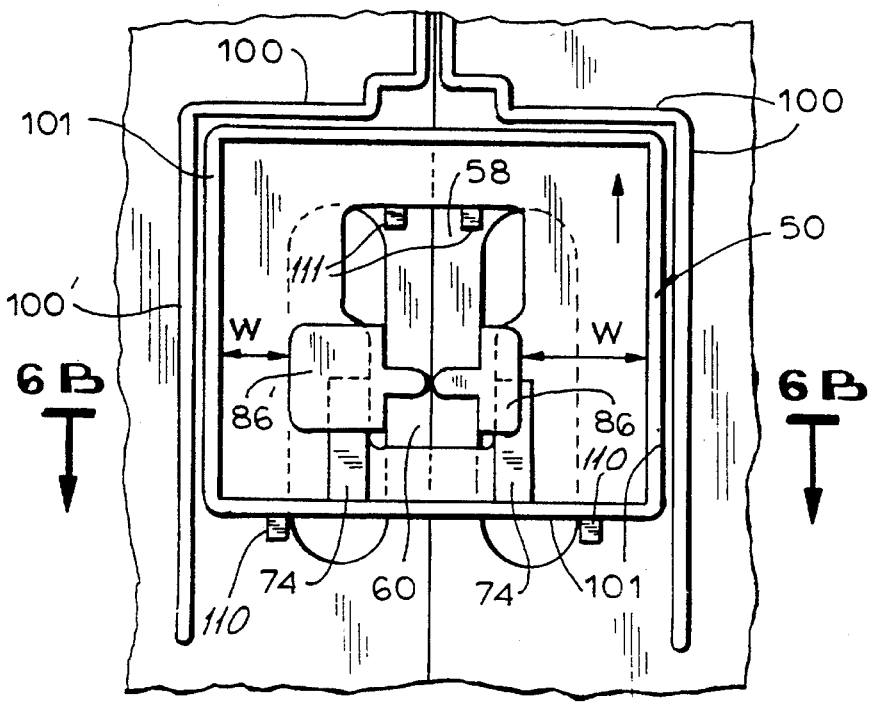
FIG. 5

FIG. 6A
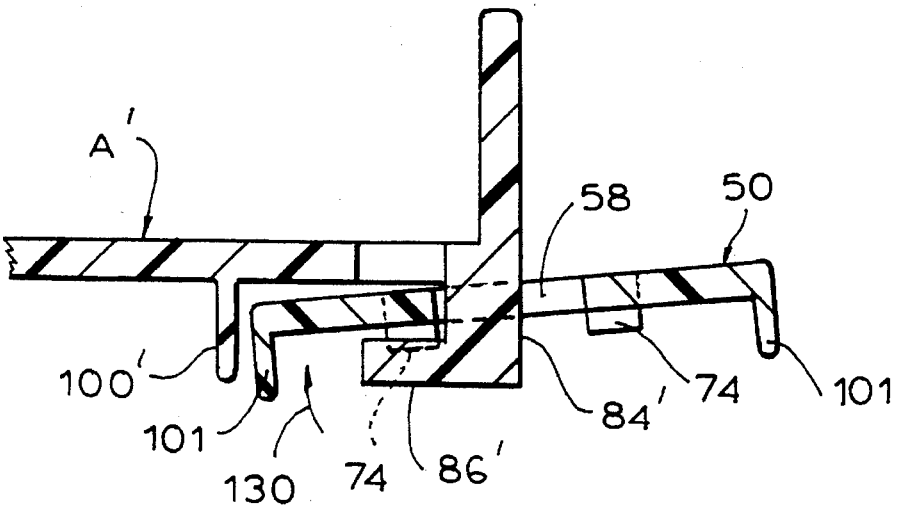
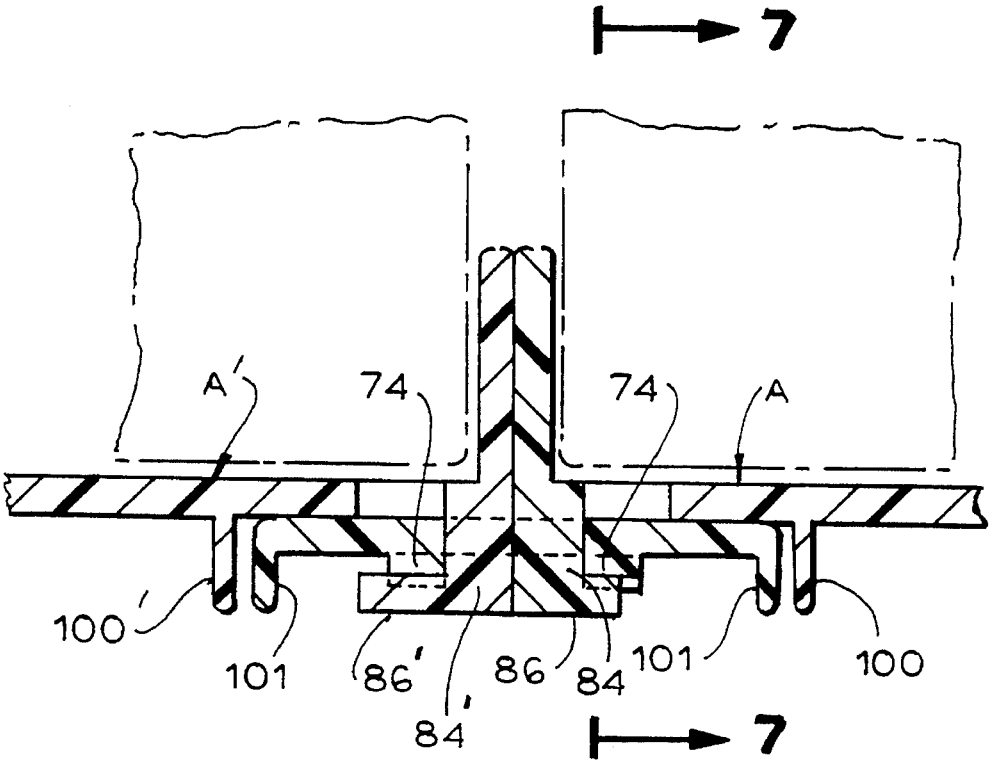
FIG. 6B

FIG. 11A
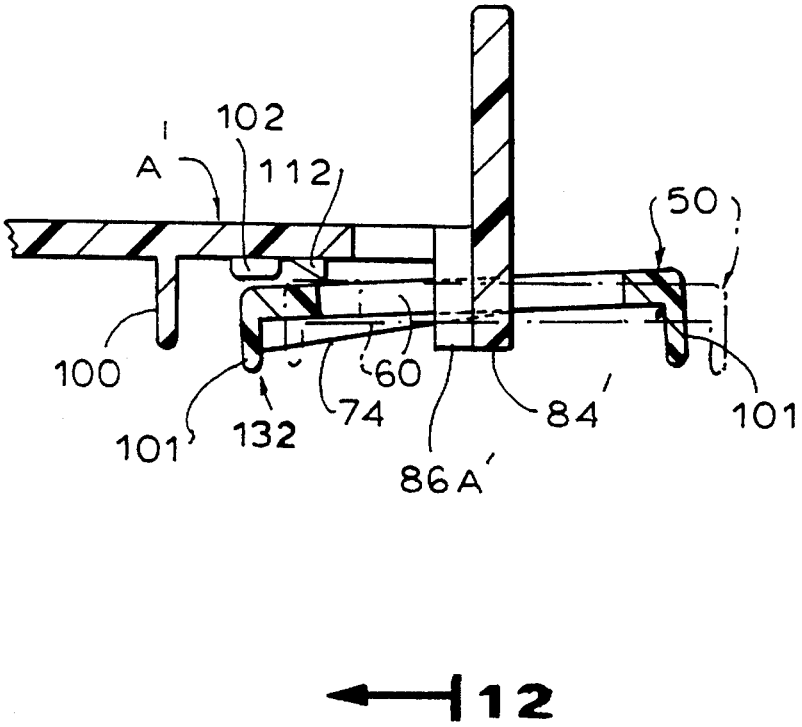
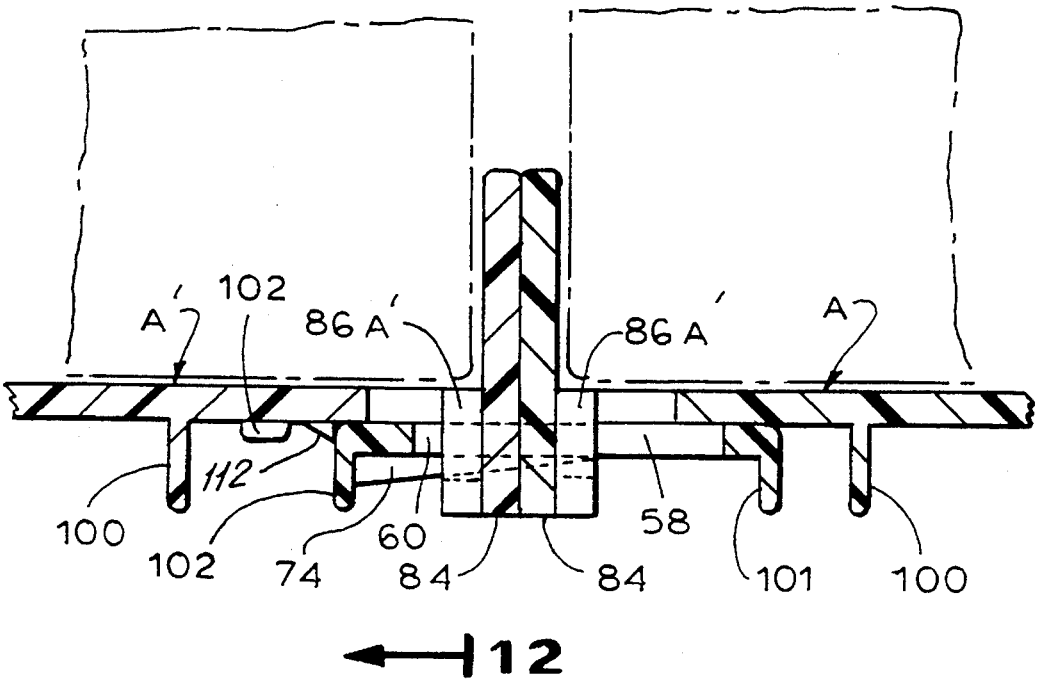
FIG. 11B

MODULAR CLIP AND ASSEMBLY USING SAME

BACKGROUND OF THE INVENTION

The present invention relates to a modular clip for releasably securing together a pair of articles for movement as a unit and to an assembly formed of a plurality of such articles held together by such modular clips, and more particularly to a rack for supporting cans, bottles or other containers in a refrigerated cabinet or chest and taking the form of an array of trays releasably secured together by such modular clips.

The use of racks in refrigeration units—as both displays and conveyances for the containers of the products being cooled, e.g., beer cans, soda cans, etc.—is a technique well-established in the art. The racks are either configured and dimensioned to provide an angular floor to facilitate a gravity feed of the containers thereon, in turn, to a retrieval zone, or adapted to be supported with the floor in such an angular mode by an appropriately inclined shelf support in the refrigerator unit. The racks themselves have taken various physical forms and have been fabricated of different types of materials. For the most part, the racks used have been of particular predetermined dimensions and have been unalterable to accommodate different spatial dimensions imposed by the site (i.e., refrigeration unit) in which the rack is to be used.

To address this problem, racks (often called "organizers") have been constructed having frangible side and/or rear portions which may be removed to reduce the appropriate dimensions of the organizer. Once these frangible side and/or rear portions were removed from the main unit, however, they could not be reintegrated with the main unit in the event that additional space became available within the refrigeration unit.

In a different approach to the same problem, with particular emphasis on enabling a variation of the lateral dimensions of the organizer so as to enable the passage thereof through various refrigeration door widths or to accommodate limited lateral space on a refrigeration shelf, adjacent units were provided with dovetail or mortise-and-tenon joining means enabling one side of a auxiliary unit of an modular organizer unit to be secured to an adjacent side of the main unit of the organizer. This approach has not proven to be entirely satisfactory in practice since the joining means may occupy an appreciable amount of space between the container-carrying trays or channels of the organizer and thus reduces the amount of product which may be displayed in an organizer occupying a given amount of lateral space on a refrigeration shelf or the projecting tenon may snap off during use. Further, during use or cleaning, an accidental relative vertical movement between the main unit and the auxiliary unit was frequently sufficient to release the joining means and allow separation of the two units.

In view of these problems with the latter approach, recourse has been had to the use of a separate and distinct coupling element to secure the modular units of the organizer together. This too has not proven to be entirely satisfactory in practice. The coupling element is typically U-shaped with the legs extending into the channels traversed by the containers (e.g., soda cans), and the bight bridging the pair of adjacent modular units. Accordingly, if the passage of the containers down the channel did not itself dislodge the coupling element, a customer reaching into the organizer (e.g., to remove a more recently loaded one of the products than the lead one or to dislodge a product which had become stuck) might accidentally dislodge the coupling element. Attempts to overcome this accidental displaceability of the coupling element resulted in the coupling element being so tight that it could not be removed without the use of tools. Further, once the relatively small element is removed from the modular units, it tends to become lost and then not be available when needed to rejoin the modular units.

While the coupling element might effectively secure the adjacent sidewalls of two modular units together against lateral separation, it typically did not restrain relative longitudinal motion of the modular units. Where a plurality of the coupling elements were used to secure together two adjacent modular units, they were typically oriented parallel to one another and acted to restrain the modular units from relative displacement only along one axis or dimension. Thus the coupling element failed to provide a sufficiently secure tri-dimensional connection to enable two modular units secured together thereby to be moved together as a unit.

Accordingly, it is an object of the present invention to provide a modular clip for releasably securing together a pair of articles, such as modular organizer units, in an assembly for tri-dimensional movement as a unit.

Another object is to provide such an assembly which releasably secures the articles together against tri-dimensional movement relative to one another.

It is also an object of the present invention to provide such a clip which, even when not releasably securing a pair of articles together, cannot be lost.

SUMMARY OF THE INVENTION

It has now been found that the above and related objects of the present invention are contained in a modular clip for releasably securing together a pair of articles for movement as a unit. Each article has an article body, a lug protruding from the article body, and a transversely-extending flange at the free end of the lug. The clip has a generally planar clip body defining a central T-shaped opening therein. The opening includes a wide aperture zone with widely spaced sides and a narrow aperture zone with relatively narrowly spaced sides, the wide and narrow apertures zones being in operative communication with one another. Each of the narrowly spaced sides defines a plane inclined relative to the clip body and extending from adjacent the wide aperture zone to adjacent a far end of the narrow aperture zone, whereby the inclined planes of the clip may be pressure fit intermediate the article body and the article flanges to resist accidental displacement of the clip from the articles when the pressure-fit clip holds in juxtaposition the lugs of a pair of adjacent articles.

Preferably the clips releasably secure together in side-to-side relationship a pair of articles for movement as a unit.

The present invention additionally encompasses an assembly comprising, in combination, at least two of the above-described modular clips and a pair of articles wherein the lugs protrude vertically from the article body and each of the narrowly spaced sides of the clip defines a vertically inclined plane. Preferably the lugs protrude downwardly from the clip body.

In a preferred embodiment, one of the pair of clips and the flanges associated therewith are oriented 90° from the other of the pair of clips and the flanges associated therewith, respectively.

In yet another embodiment the assembly comprises, in combination, at least one pair of modular clips and a pair of articles. Each article has an article body, at least a pair of lugs protruding from the article body, and a transversely-extending flange at the free end of each lug. Each of the clips holds the pair of articles in juxtaposition, one of the pair of clips and the flanges associated therewith being oriented 90° from the other of the pair of clips and the flanges associated therewith, respectively.

Preferably there are three of the clips in series holding the pair of articles in juxtaposition, the end clips being oriented in a first direction and the intermediate clip being oriented in a second direction 90° from the first direction.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein:

FIG. 4 is a partially assembled bottom plan view thereof;

FIG. 5 is a fully assembled bottom plan view thereof;

FIGS. 6A and 6B are sectional views taken along the line 6A—6A of FIG. 4 (but with only one article shown) and the line 6B—6B of FIG. 5, respectively;

FIGS. 11A and 11B are sectional views taken along the line 11A—11A of FIG. 9 and line 11B—11B of FIG. 10B, respectively.

DETAILED DESCRIPTION OF THE PREFERRED EMBODIMENTS

Figure 1:
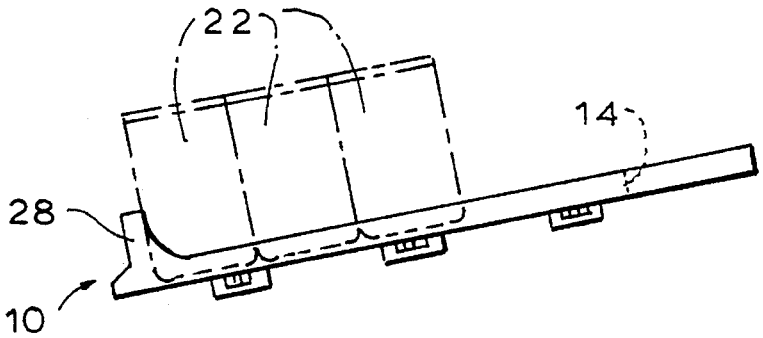
FIG. 1 is a side elevational view of an assembly according to the present invention disposed at an angle to the horizontal and having product shown therein in phantom line.
Figure 2:
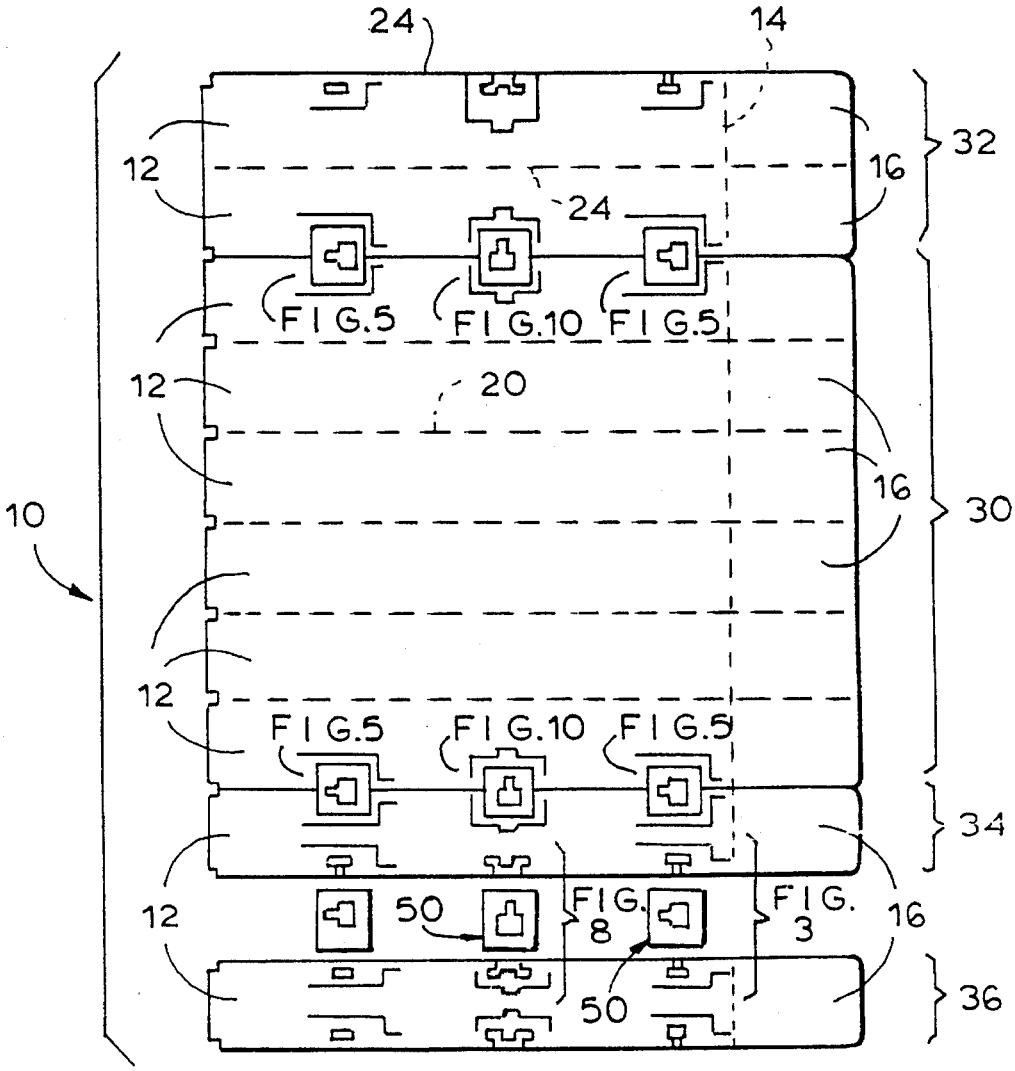
FIG. 2 is a partially exploded bottom plan view of an assembly according to the present invention comprising a main modular unit and an auxiliary modular unit on either side thereof.

Referring now to the drawing, and in particular to FIGS. 1 and 2 thereof, therein illustrated is a rack or organizer according to the present invention, generally designated by the reference numeral 10. The rack 10 is a columnar array of side-by-side trays, generally designated 12. The trays 12 are fabricated of a high mechanical strength molded plastic composition. The trays 12 may be of different lateral widths so as to accommodate articles of different dimensions, or may be of the same width, as illustrated. The trays 12 may include low friction rails (not shown) upon which the containers bear during their travel and numerous spaced openings in the tray to facilitate the distribution and circulation of a cooling medium.

Adjustability of the length of the rack is provided by a fracture line 14 or line of weakness which enables the back auxiliary portion 16 of the trays to be flexed relative to the main portions 12 and eventually separated therefrom along the line of weakness 14. Each tray 12 is integrally formed with upstanding sidewalls 24 which serve as guides and retainers for the containers 22 which are stored upon the shelf along the tray rails. Each tray 12 has a lattice-like floor 20 with openings or cut-out sections to facilitate the circulation of cooling fluid generated in the cooler. Integrally formed with the tray floor 20 and extending linearly the full length of the tray itself are elongated raised bars or rails (not shown) on which the containers 20 to be cooled are supported for travel. At it lower or delivery end, each tray 12 is formed with a reinforced, upstanding endwall 28 to further stabilize the strength of the assembly.

As illustrated in FIG. 2, the main rack 30 is comprised of six trays 12 and has at one end a two tray auxiliary unit 32 and at the other end a one tray auxiliary unit 34. Additionally, the main rack 30, with its auxiliary units 32, 34, is illustrated in the process of having added thereon a further one tray auxiliary unit 36.

Figure 3:
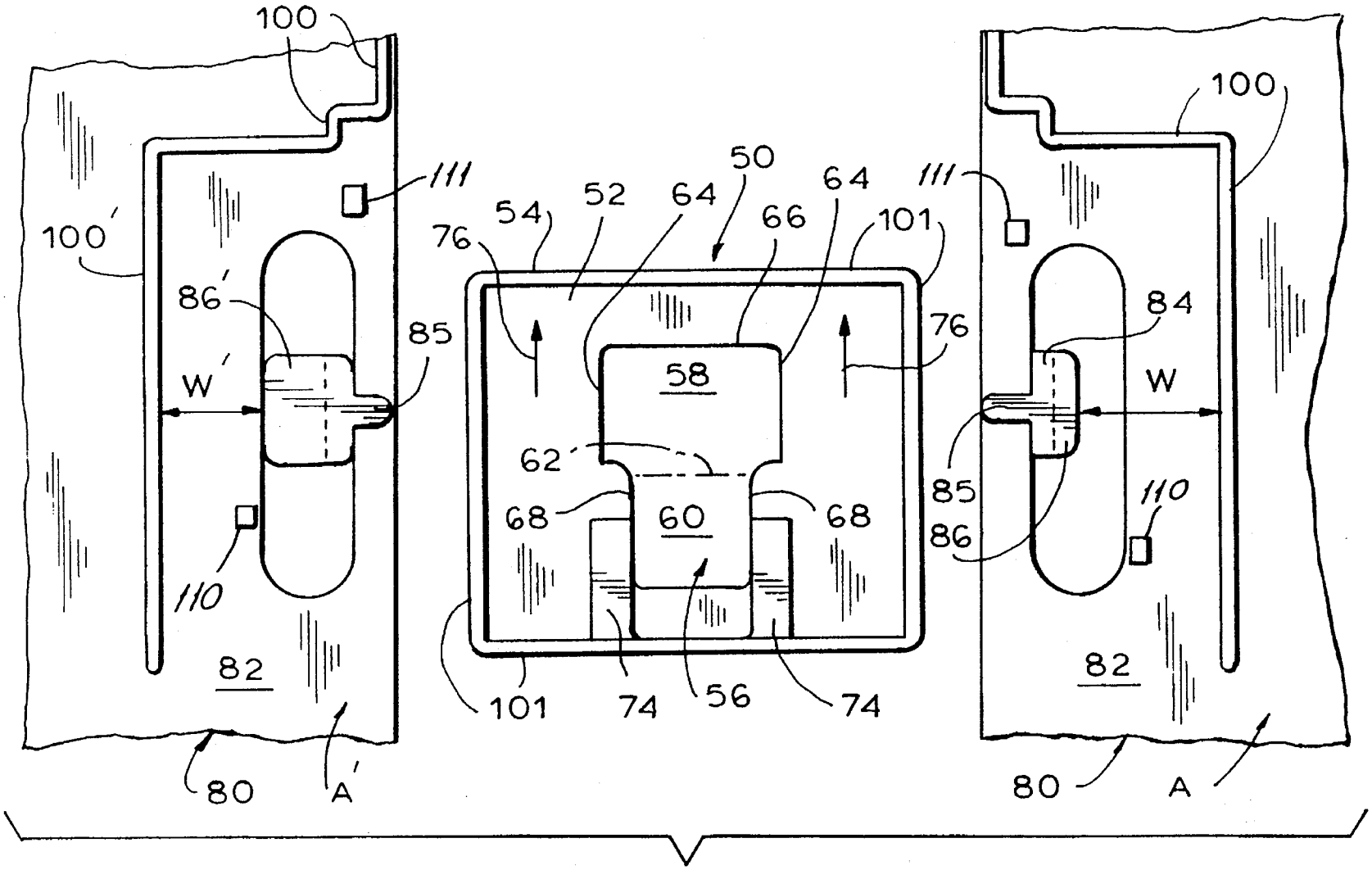
FIG. 3 is a fragmentary fully exploded bottom plan view of a first joint of the assembly.
Figure 8:
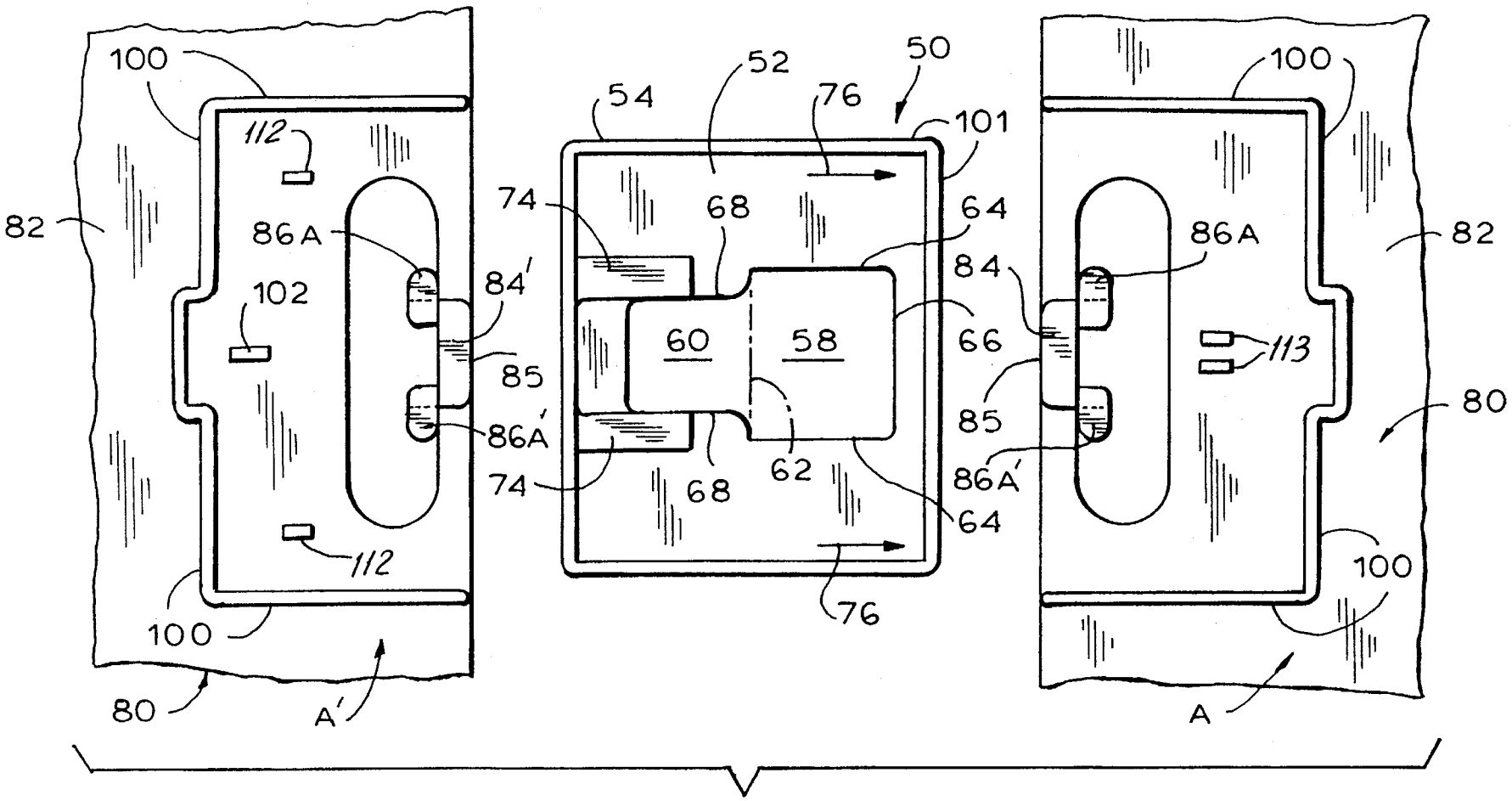
FIG. 8 is a fragmentary fully exploded bottom plan view of a second joint of the assembly.

Referring now to FIGS. 3 and 8, therein illustrated are the modular clips according to the present invention, generally designated 50, which are used to releasably join the trays 12 or other articles according to the present invention. If desired, the clips 50 may be used to join either auxiliary side trays 32, 34, 36 to a main rack 30 of trays, as illustrated, or an auxiliary back portion to a main front portion of the rack. The clips 50 are identical except that the view thereof in FIG. 8 is rotated 90° clockwise from the view thereof in FIG. 3. The clips 50, like the trays 12, are fabricated of a high mechanical strength molded plastic composition. The modular clip 50 defines a generally planar clip body 52 which is preferably surrounded by an edge wall 101 to further rigidify the clip body 52. The clip body 52 defines a central T-shaped opening 56 therethrough which in turn includes a wide aperture zone 58 and a narrow aperture zone 60. The wide and narrow aperture zone 58, 60 are in operative communication with one another across the imaginary dividing line 62 (illustrated in FIG. 3 in phantom line). The wide aperture zone 58 defines a pair of widely spaced sides 64 and an end 66, while the narrow aperture zone 60 defines a pair relatively narrowly spaced sides 68 and an end 70. For illustrative purposes, the T-shaped opening 56 will be described as having a top wide aperture zone end 66, a bottom narrow aperture zone end 70 and lateral sides 64, 68 so as to provide reference points regardless of the orientation of the clip 50. It will be appreciated that the widely spaced sides 64 gradually and smoothly approach one another to become the narrowly spaced side 68.

Each narrowly spaced side 68 defines a plane 74 inclined relative to the clip body 52, each plane 74 extending from adjacent the wide aperture zone 58 (but preferably being spaced from the imaginary dividing line 62) to adjacent the far end 70 of the narrow aperture zone 60. Indeed, as illustrated, the plane 74 may extend beyond the narrow aperture zone 60 all the way to the edge wall 101 adjacent thereto. Keeping in mind that a bottom plan view of the clip 50 is illustrated in FIGS. 3 and 8, the planes 70 protrude downwardly at an angle from the end adjacent the narrow aperture zone 58 to the end adjacent the edge wall 101 (adjacent end wall 70 of the narrow aperture zone 60).

Printed or raised indicia 76 may be provided on the bottom face of the clip body 52 to illustrate the desired direction of motion of the clip 50 when it is being used to releasably secure two articles together.

As noted above, while the clip 50 of the present invention is particularly adapted for joining together of a main rack and auxiliary modular units to be added to the main rack, the modular clip may be used for releasably securing together a pair of articles A, A' (such as trays or tray portions) for movement as a unit wherever each article A, A' has an article body 80, preferably with a generally planar bottom 82, a lug 84, 84' projecting from the article body, preferably downwardly as illustrated, and at a first joint a transversely-extending flange 86, 86' at the free end of the lug 84, 84', respectively. The inclined planes 74 of the clip 50 are configured, dimensioned and angled such that the plane 74 makes a pressure fit intermediate the bottom surface of the article body 52 and the upper surface of the article flanges 86, 86', thereby to preclude accidental displacement of the clip 50 from the articles A, A' when the pressure-fit clip 50 holds in juxtaposition the lugs 84, 84' of a pair of adjacent articles A, A'. It will be appreciated by those skilled in the art that the inclined planes 74 not only assist in preventing accidental displacement of the clip from the articles, but further ensure that the articles will remain in the same horizontal planes without looseness. Thus when the lugs 84, 84' are disposed in the wide aperture zone 58 with the flanges 86, 86' extending beyond the widely spaced sides 64 (that is, downwardly further than such sides, as illustrated in FIG. 4 and 6A), the clip 50 may be moved in the direction of arrow 76, thereby to force the lugs 84, 84' to be forcibly drawn together by the camming action of sides 64, 68 as the lugs enter the narrow aperture zone 60. Simultaneously, the inclined planes 74 become wedged in the gaps intermediate the flanges 86, 86' and the planar body 52. As a result of this action, the clip 50 is press fit into the gaps and secures the articles A and A' against both relative lateral displacement and relative vertical displacement. After use of a clip 50 to secure the articles A, A' together at the first joint illustrated in FIGS. 3–7, there remains, however, the possibility of a relative movement of the articles A and A' to the right and left as illustrated in FIG. 3 and then upwardly and downwardly as illustrated in FIGS. 6A and 6B.

Figure 9:
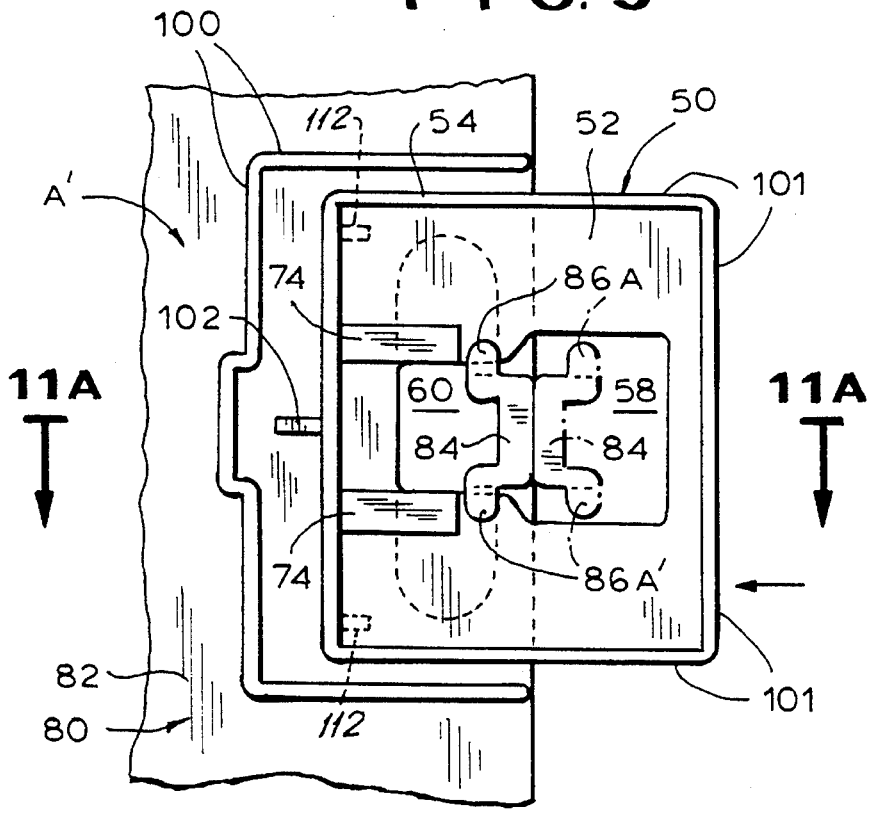
FIG. 9 is a first partially assembled bottom plan view thereof, with the lug and flanges of a second article being illustrated in phantom line.

Referring now to FIG. 8, an identical clip 50 is preferably used to secure articles A, A' together at a second joint. Each article A, A' has an article body 80, preferably with a generally planar bottom surface 82, a lug 84 or 84' protruding from the article body 82, preferably downwardly as illustrated, and two transversely-extending flanges 86A, 86A' at the free end of each lug 84, 84'. It will be appreciated by those skilled in the art that, just as the clip 50 of FIG. 3 and the clip 50 of FIG. 8 are oriented 90° apart, so the flanges 86A, 86A' are oriented 90° apart from the flanges 86, 86' of FIG. 3. When lugs 84, 84' of articles A and A', respectively, are disposed in the wide and narrow aperture zones 58, 60, respectively, as illustrated in FIG. 9, the flanges 86A, 86A' extend in a plane parallel to but below the clip body 52. Both of the flanges 86A and 86A' on lug 84 of one article A are disposed below the wide aperture zone 58, while both the flanges 86A and 86A' on lug 84' of the other article A' are disposed below the narrow aperture zone 60, but before the beginning of the inclined planes 74. When the clip 50 is then moved in the direction of arrows 76, the lug 84' of article A' shifts further into the narrow aperture zone 60 and the lug 84 of article A enters the narrow aperture zone 60. Portions of the inclined planes 74 are then disposed between the flanges 86A and 86A' of article A (and optionally article A') and the body bottom 82 of article A (and optionally article A'). Comparing FIGS. 8–10 and FIGS. 3–5, it will be appreciated that the clip system illustrated in FIGS. 8–10 precludes both relative longitudinal motion of the articles A, A' and relative vertical displacement thereof.

Figure 10A:
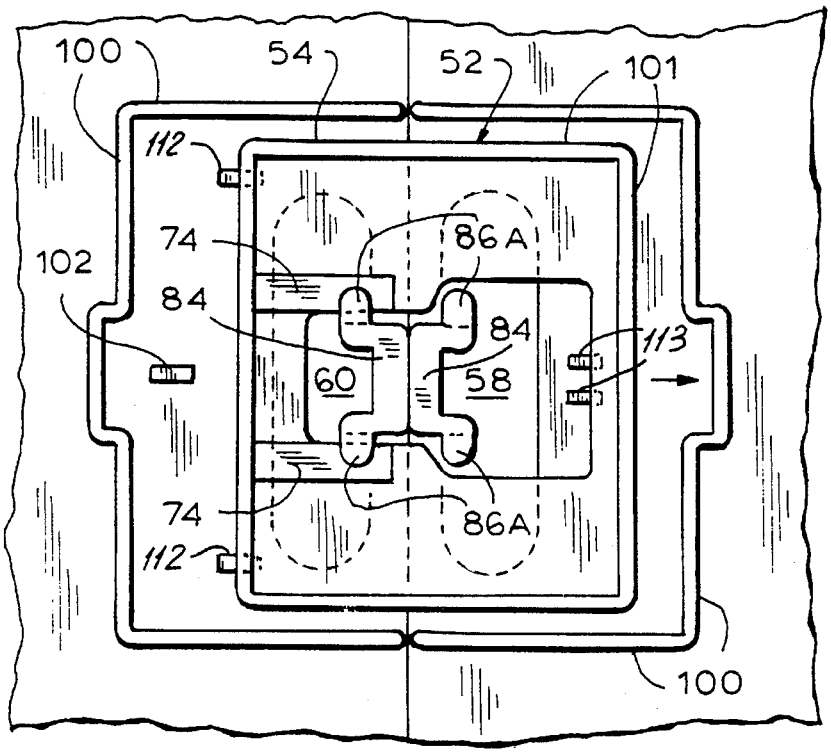
FIG. 10A is a second partially assembled bottom plan view thereof, including the second article.
Figure 10B:
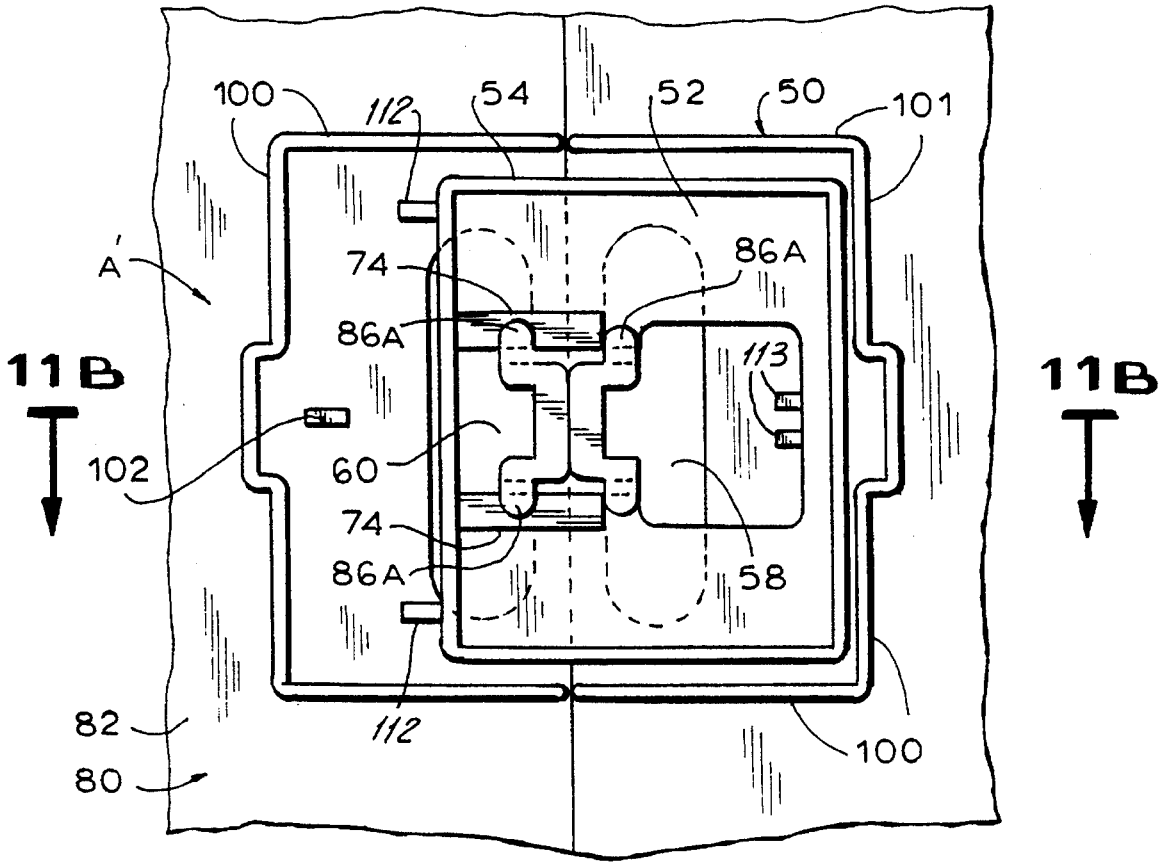
FIG. 10B is a fully assembled bottom plan view thereof, including the second article.

When a pair of articles A, A' are held in place both by the first joint of FIGS. 3–5 and the second joint of FIGS. 8–10, then the articles are held together against relative displacement longitudinally, laterally and vertically. In other words, they are locked together three dimensionally for movement as a unit. This is because the articles A, A' are joined by a pair of clips, wherein one of the pair of clips 50 and the flanges associated therewith (say, as illustrated in the first joint of FIGS. 3–5) are oriented 90° from the other of the pair of clips and the flanges associated therewith (say, as illustrated in the second joint of FIGS. 8–10), respectively.

As the multiple clip assembly of the present invention secures the pair of articles together tri-dimensionally (that is, against relative longitudinal, transverse or vertical movement), it may be used either to releasably secure the modular units in side-to-side or back-to-front relationship.

Depending upon the length of the dimension upon which the articles are being joined, there may be three or even more of the clips 50 in series holding the pair of articles A, A' in juxtaposition. Where there are three of the clips in series, as illustrated in FIG. 2, the end clips are preferably oriented in a first direction and the intermediate clip is oriented in a second direction 90° from the first direction. Where there are more than three of the clips in series, preferably alternating clips will be oriented 90° from each other.

The lugs 84, 84' of FIGS. 3–7 preferably additionally define abutment surfaces 85 which extend to the adjacent edges of the articles A, A' so that, when the clip 50 is being applied to releasably secure the articles A, A' together, and before the inclined planes 74 are in an operative position, the articles will not overlap or underlap one other. The lug surfaces 85 illustrated in FIGS. 8–10, like the lug surfaces 85 of FIGS. 3–5, act to prevent accidental overlapping or underlapping of the articles A, A' before the inclined planes 74 have begun to function.

In order that the first and second joints do not deform the racks 10 upwardly in the region of the joints and thus lead to possible rack breakage, each element of the rack—the main unit, any side auxiliary units, and any back auxiliary units—is provided with downwardly depending ribs 100 not only immediately about the joints but also at other strategically placed locations so that the weight distribution of the rack and the products thereon is roughly equally distributed among the ribs.

The clips 50 each contain a peripheral or marginal rib 101 depending downwardly therefrom as far as the ribs 100 of the racks 10.

Referring now to FIG. 5, in order to prevent the clip 50 of the first joint from becoming separated from both of the articles A, A' when the clip 50 is no longer being used to keep the articles together, one of the flanges 86, 86' (the latter, as illustrated) extends toward an adjacent rib 100' so far that the passageway of width W, which normally accommodates passage therethrough of the width of the clip 50 from the wide aperture zone 58 to the adjacent side rib 101, is so covered by the flange 86' that the effective width is reduced to W' such that the clip 50 cannot be accidentally lifted past the flange 86'. On the other hand, on the other side, the passageway of width W is unaffected so that the width of the clip 50 between the wide aperture zone 58 and the adjacent side rib 101 is able to be lifted past flange 86.

Thus, as W' is less than W, the clip 50 remains fixed to article A' although easily detachable from article A.

Referring now to FIG. 10, to insure that the clip 50 of the second joint remains attached to one of the articles A, A', a lug 102 is disposed on the undersurface of article A' so as to preclude rearward movement of the clip 50 such that the lug 84' and flanges 86A, 86A' of article A' cannot be accidentally moved into the wide aperture zone 58. Thus, even after the articles A, A' are separated, with the lug 84 and flanges 86A, 86A' of article A passing through the wide aperture zone 58, the corresponding lug 84' and flanges 86A, 86A' of article A' remain trapped in the narrow aperture zone 60 so that clip 50 is secured to article A' against accidental displacement.

To summarize, while the bulk of the ribs 100 serve merely to space the bottom of the rack 10 uniformly above the support surface, the rib 100' of the first joint and the lug 102 of the second joint have functional roles in precluding accidental separation of the clips from the articles A'.

In order to provide a snap-type feedback mechanism which enables the user to determine when a clip has been moved into the locking position (where it is holding a pair of articles A, A' together) or into the unlocking position (such that it enables the articles A, A' to be separated). In the case of the first joint (illustrated in FIGS. 3–7), the fine or small lugs 110 on the articles A, A' adjacent the back of the clip 50 stress the clip as it is being moved forwardly from the unlocking position (FIG. 4) to the locking position (FIG. 5), the stress terminating with a "snap" sound as the clip enters the locking position when the clip back end clears the fine lugs 110. It will be appreciated that the fine lugs 110 further assist in maintaining the clip in the locking position, especially where the fine lugs define a slight downward incline and an abrupt cliff-like end which facilitate movement of the clip into the locking position but resist the movement of the clip out of the locking position. Another pair of fine lugs 111 inclined in the same direction as the fine lugs 110, is disposed on the articles A, A' adjacent the front of the clip. The fine lugs 111 stress the clip as it is being moved from the unlocking position to the locking position, the stress terminating with a "snap" sound as the fine lugs 111 enter the wide aperture zone 58 of the clip. The fine lugs 111, like the fine lugs 110, further assist in maintaining the clip in the locking position.

In the case of the second joint (illustrated in FIGS. 8–12), the fine lugs 112 on the article A' adjacent the back of the clip 50 are oriented 90° from the fine lugs 110 of the first joint. The fine lugs 112 stress the clip as it is being moved forwardly from the unlocking position to the locking position, the stress terminating with a "snap" sound as the clip enters the locking position when the clip back end clears the fine lugs 112. Optionally there are two sets of fine lugs 112, one fine lug being inclined in one direction and one fine lug being inclined in the opposite direction.

In addition to the fine lugs 112, there are fine lugs 113 on article A adjacent the front of the clip 50. Fine lugs 113 are inclined in the same direction as fine lugs 112*a* and disposed such that they stress the front part of the clip as its being moved forwardly into the locking position, the stress being relieved with a "snap" as the fine lugs 113 enter the wide aperture zone 58 of the clip in the locking position. The fine lugs 113, like the fine lugs 112, assist in maintaining the clip of the second joint in the locked position.

While the clips 50 are substantially rigid, they are preferably resiliently deformable under sufficient stress. The resilient deformability of the clips 50 enables them to be secured to an article A' after the article A' and clip 50 have been separately formed, and yet maintain the clip 50 secured to article A' against accidental separation.

Figure 7:
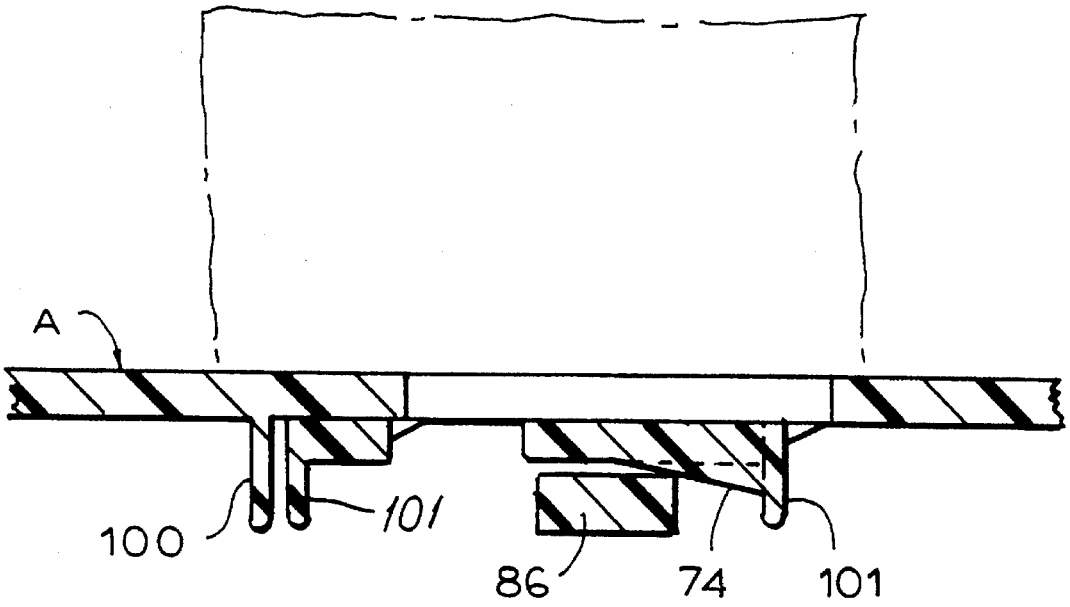
FIG. 7 is a sectional view taken along the lines 7—7 of FIG. 6B.
Figure 12:
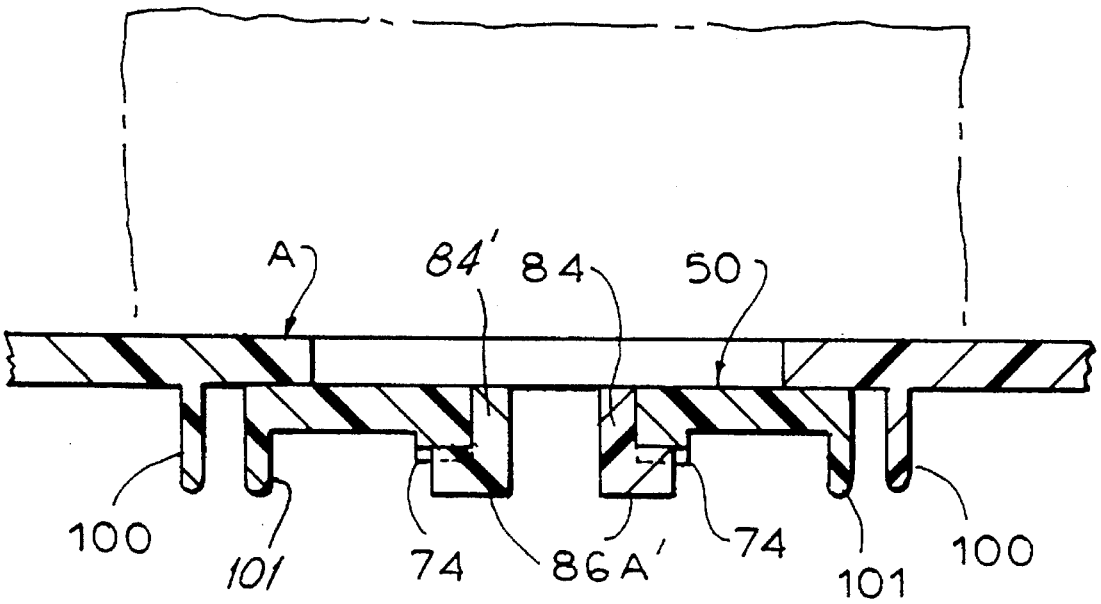
FIG. 12 is a sectional view taken along the line 12—12 of FIG. 11B.

Thus, to form the first joint illustrated in FIGS. 3–5, a clip 50 is first positioned on an article A' as illustrated in FIG. 6A. Manual pressure is then applied to resiliently deform the clip 50 by pressing upwardly (in the direction of arrow 130) on the clip edge wall 101 adjacent the rib 100' of article A'. The clip 50 then assumes the position illustrated in FIG. 6B. At this point an article A may be inserted into the clip 50 (with the flange 86 of article A passing through the wide aperture zone 58), and the clip 50 then moved relative to both articles A and A' so that the lugs 84, 84' thereof become trapped in the narrow aperture zone 60, as illustrated in FIG. 7.

Similarly, with regard to the second joint illustrated in FIGS. 8–9, a clip 50 is first positioned on an article A' with the flanges 86A and 86A' and lug 84' passing through the wide aperture zone 58 thereof, as illustrated in FIG. 11A. Manual pressure then is exerted upwardly (in the direction of arrow 132) on the clip edge wall 101 adjacent the rib 100 article A, so that the clip 50 first assumes an intermediate position (illustrated in phanton line in FIG. 11A) in which it is substantially parallel to the article bottom 82. The manual pressure causes the clip 50 to momentarily resiliently deform so that it can assume the position illustrated in FIG. 11B. To this end, the clip-facing surface of lug 102 may be configured to promote a caming action of the clip along the lug. The clip 50 is now secured to the article A' against accidental displacement as the lug 102 precludes movement of the clip 50 such that the lug 84' can enter the wide aperture zone 58. At this point only lug 84 of article A is in the wide aperture zone 58. Now, the clip 50 is moved so that both of lugs 84, 84' enter the narrow aperture zone 60, and the flanges 86A, 86A' of lugs 84 and 84' trap the inclines 74 of clip 50 intermediate the flanges 86A, 86A' and the body bottom 82 of article A'.

The present invention provides a modular clip for releasably securing together a pair of articles, such as modular organizer units, in an assembly for tri-dimensional movement as a unit. The assembly releasable secures the articles together against tri-dimensional movement relative to one another. The clip of the present invention is secured to one of the pair of articles such that, even when the clip is not releasably securing a pair of the articles together, it cannot become lost.

Now that the preferred embodiments of the present invention have been shown and described in detail, various modifications and improvements thereon will be readily apparent to those skilled in the art. Accordingly, the spirit and scope of the present invention is to be construed broadly and limited only by the appended claims, and not by the foregoing specification.

We claim:

1. A modular clip for releasably securing together a pair of articles for movement as a unit, each article having an article body, a lug protruding from the article body, and a transversely-extending flange at the free end of the lug, said clip comprising:

a generally planar clip body defining a central T-shaped opening therein including a wide aperture zone with widely spaced sides and a narrow aperture zone with relatively narrowly spaced sides, said wide and narrow apertures zones being in operative communication with one another, each of said narrowly spaced sides defining a plane inclined relative to said clip body and extending from adjacent said wide aperture zone to adjacent a far end of said narrow aperture zone, whereby said inclined planes of said clip may be pressure fit intermediate the article body and the article flanges to resist accidental displacement of said clip from the articles when said pressure-fit clip holds in juxtaposition the lugs of a pair of adjacent articles.

2. An assembly comprising, in combination, a pair of modular clip and a pair of articles:

each article having an article body, at least a pair of lugs protruding vertically from said article body and a transversely-extending flange at the free end of each said lug; and at least a pair of modular clips releasably securing together said pair of articles for movement as a unit, each said clip having a generally planar clip body defining a central T-shaped opening therein including a wide aperture zone with widely spaced sides and a narrow aperture zone with relatively narrowly spaced sides, said wide and narrow apertures zones being in operative communication with one another, each of said narrowly spaced sides defining a plane vertically inclined relative to said clip body and extending from adjacent said wide aperture zone to adjacent a far end of said narrow aperture zone, whereby said inclined planes of said clip are pressure fit intermediate the article body and the article flanges to releasably resist accidental displacement of said clip from said articles when said pressure-fit clip holds in juxtaposition the lugs of a pair of adjacent articles for movement as a unit.

3. The assembly of claim 2 wherein one of said pair of clips and the flanges associated therewith are oriented 90° from the other of said pair of clips and the flanges associated therewith, respectively.

4. The assembly of claim 2 wherein said lug protrudes downwardly.

5. The assembly of claim 2 wherein said clips releasably secure together in side-to-side relationship a pair of articles for movement as a unit.

6. An assembly comprising, in combination, at least one pair of modular clips and a pair of articles, each article having an article body, at least a pair of lugs protruding from said article body, and a transversely-extending flange at the free end of each said lug, each of said clips holding said pair of articles in juxtaposition, one of said pair of clips and the flanges associated therewith being oriented 90° from the other of said pair of clips and the flanges associated therewith, respectively.

7. The assembly of claim 6 where there are three of said clips in series holding said pair of articles in juxtaposition, the end clips being oriented in a first direction and the intermediate clip being oriented in a second direction 90° from said first direction.

* * * * *